United States Patent [19]

Haluda et al.

[11] Patent Number: 4,828,148

[45] Date of Patent: May 9, 1989

[54] FLUID MIXING DISPENSER

[75] Inventors: Raymond P. Haluda, South Bend, Ind.; John F. Trout, St. Charles, Ill.

[73] Assignee: Lily Corporation, Aurora, Ill.

[21] Appl. No.: 178,766

[22] Filed: Mar. 29, 1988

Related U.S. Application Data

[63] Continuation-in-part of Ser. No. 9,045, Jan. 28, 1987, abandoned, which is a continuation of Ser. No. 818,885, Jan. 14, 1986, abandoned.

[51] Int. Cl.[4] ..... B67D 5/46

[52] U.S. Cl. ..... 222/134; 222/137; 222/334; 222/288; 417/521

[58] Field of Search ..... 222/134, 135, 136, 137, 222/288, 334; 91/491; 417/273, 521, 429

[56] References Cited

U.S. PATENT DOCUMENTS

| | | | |
|---|---|---|---|
| 1,007,275 | 10/1911 | Desmond | 417/521 |
| 3,642,175 | 2/1972 | Robbins | 222/135 |
| 3,871,556 | 3/1975 | Breer et al. | 222/134 |
| 3,963,148 | 6/1976 | Proni et al. | 222/134 |
| 4,002,271 | 1/1977 | Buck | 222/134 |

*Primary Examiner*—H. Grant Skaggs
*Attorney, Agent, or Firm*—Thomas J. Dodd

[57] ABSTRACT

A dispenser for flowable materials, such as resins, which includes dual opposed pistons. As each piston fills with material, the piston rods extend into contact with an actuator member. A cam member is activated when the rods are fully extended to force the material out of the cylinders where it is mixed and then discharged from the dispenser.

19 Claims, 6 Drawing Sheets

FLUID MIXING DISPENSER

CROSS-REFERENCE TO RELATED APPLICATIONS

This application is a continuation-in-part of Application Ser. No. 009,045, now abandoned, filed Jan. 28, 1987, which is a continuation of Application Ser. No. 818,885, filed Jan. 14, 1986, now abandoned.

FIELD OF THE INVENTION

This invention relates to a fluid dispenser and will have special, but not limited application to a dispenser for mixing two reactive components and ejection of the mixed components at a high discharge pressure.

BACKGROUND OF THE INVENTION

Faults in concrete structures have long been a problem area for civil engineers. Repair work was often difficult due to the lack of an appropriate material to fill the void and prevent further cracking of the structure. As the faults worsened in condition, the structures (such as bridges, buildings, roads, etc.) had to be completely replaced at great cost. Additionally, cracks are formed at cold joints or abutting concrete wall structures.

Recently, it has been discovered that by injecting an epoxy compound into the void of the fault, the fault may be sealed and further cracking inhibited. The major problem with epoxy is that it hardens very quickly and, therefore, the base and catalyst resins cannot be mixed until just prior to application. Since many fault cracks are only 0.010 to 0.001 inches wide and therefore must be filled with material under high pressures (300 psi and above), special dispensing machines were developed to first mix the epoxy resins then discharge the mixture under high pressure. Prior machines utilized gear pumps which were inefficient due to gear slippage under high pressure. Portable piston pumps have been used but are either not accurate or efficient when injecting epoxy resins at high pressure or require higher than normally expected maintenance and part replacement.

SUMMARY OF THE INVENTION

The dispenser of this invention includes dual opposed pistons which are adjustably secured within the dispenser housing. An actuator member is positioned between the piston rods. Tubing through which material is supplied under pressure extends between a pair of delivery tanks and the dispenser. As the piston cylinders fill with material, the piston rods are extended into contact with the actuator member which then activates a switch. When activated, the switch activates a motor to raise a cam member which also engages the piston rod and which urges the piston rods back into the cylinders. As the rods are forced into the cylinders, material in the cylinders is discharged into a mixing head under pressure where the material is mixed and discharged through an outlet nozzle to the concrete fault or crack.

The piston rods are adjustable so that they are always positioned perpendicular to the camming edges of the cam member. By providing an actuator and an interacting cam, the dispenser will not dispense material until the correct amount of material has entered each piston cylinder to ensure that an accurate basecatalyst ratio reaches the mixing head.

Accordingly, it is an object of this invention to provide for a high pressure fluid mixing dispenser which is safe to use.

Another object of this invention is to provide a novel fluid dispenser for high pressure discharge of accurately mixed material.

Another object of this invention is to provide for a fluid dispenser which provides highly accurate mixing of base and catalyst resins.

Another object of this invention is to provide a fluid mixing dispenser which is efficient and economical to use and maintain.

Another object of this invention is to provide for a fluid mixing dispenser which is adjustable to deliver a plurality of different component ratios of highly viscous material.

Other objects of this invention will become apparent upon a reading of the following description.

DESCRIPTION OF THE PREFERRED EMBODIMENTS

Figure 1:
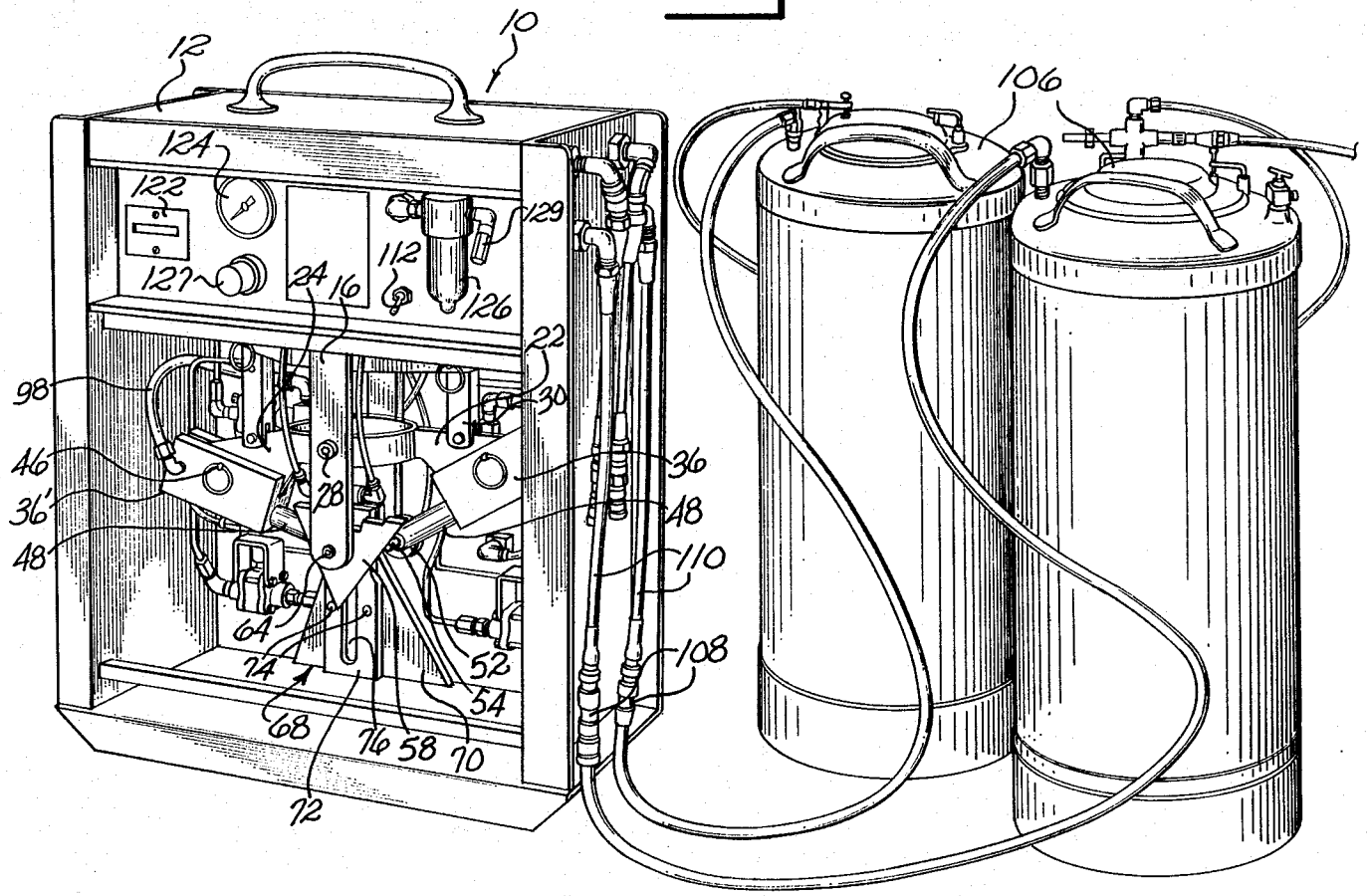
FIG. 1 is a perspective view of the fluid dispenser connected to delivery tanks.
Figure 3:
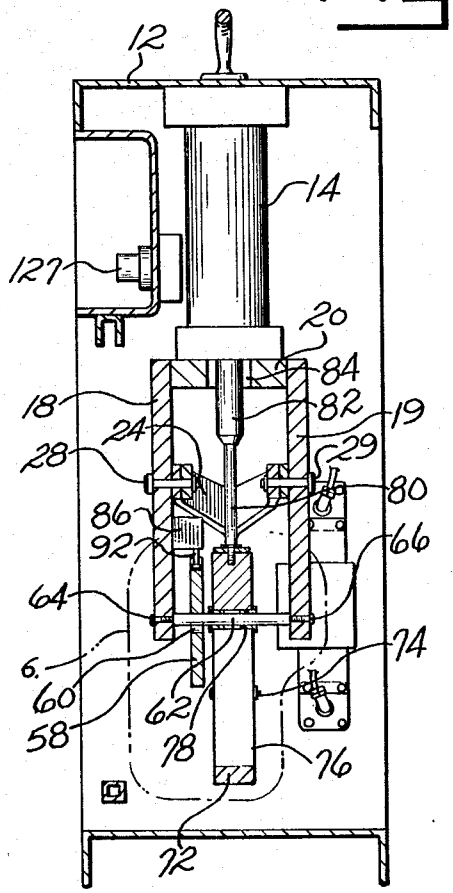
FIG. 3 is a longitudinal sectional view taken along line 3—3 of FIG. 2.
Figure 2:
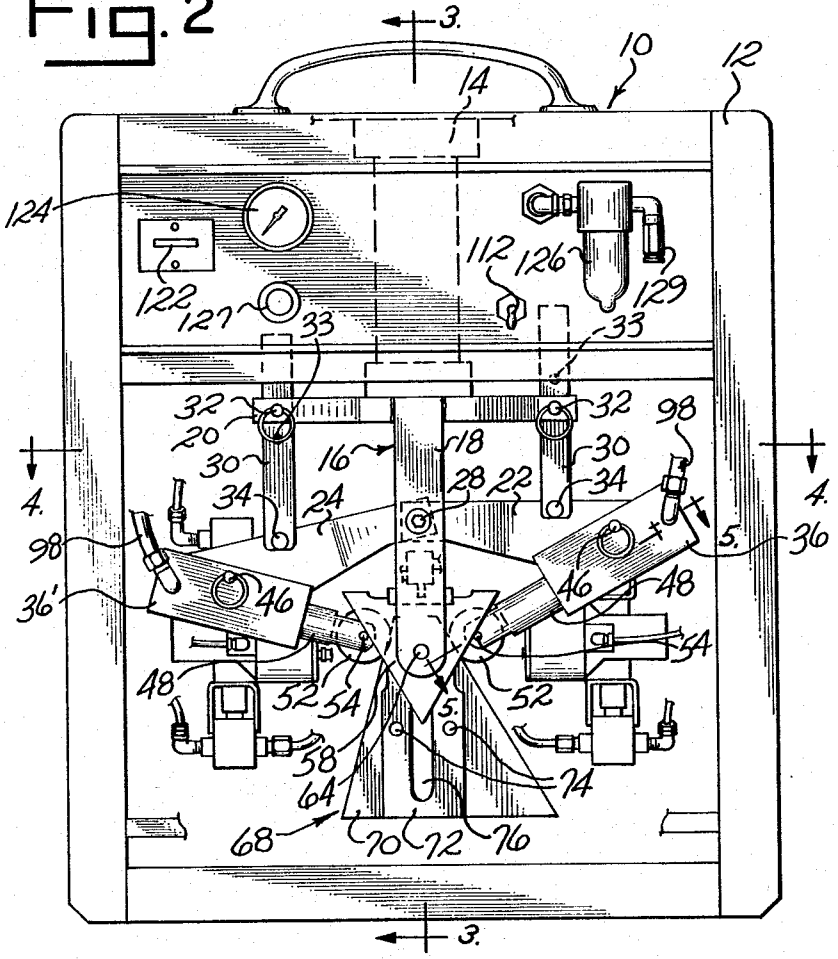
FIG. 2 is a front elevational view of the dispenser.
Figure 4:
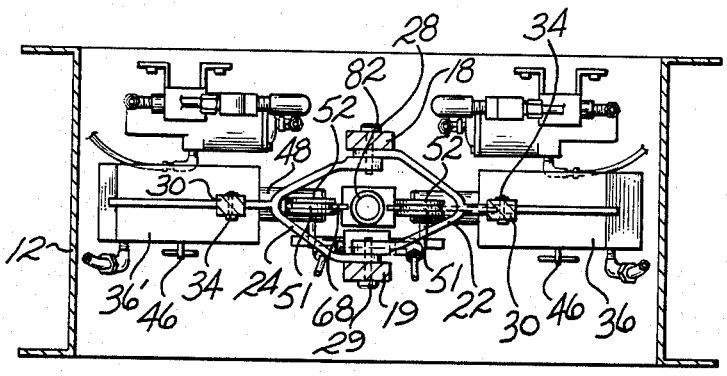
FIG. 4 is a cross sectional view taken along line 4—4 of FIG. 2.
Figure 5:
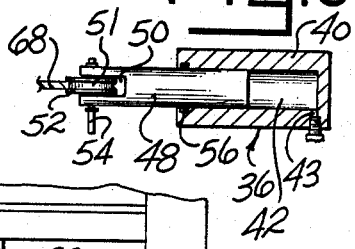
FIG. 5 is a sectional view of a piston taken along line 5—5 of FIG. 2.
Figure 11:
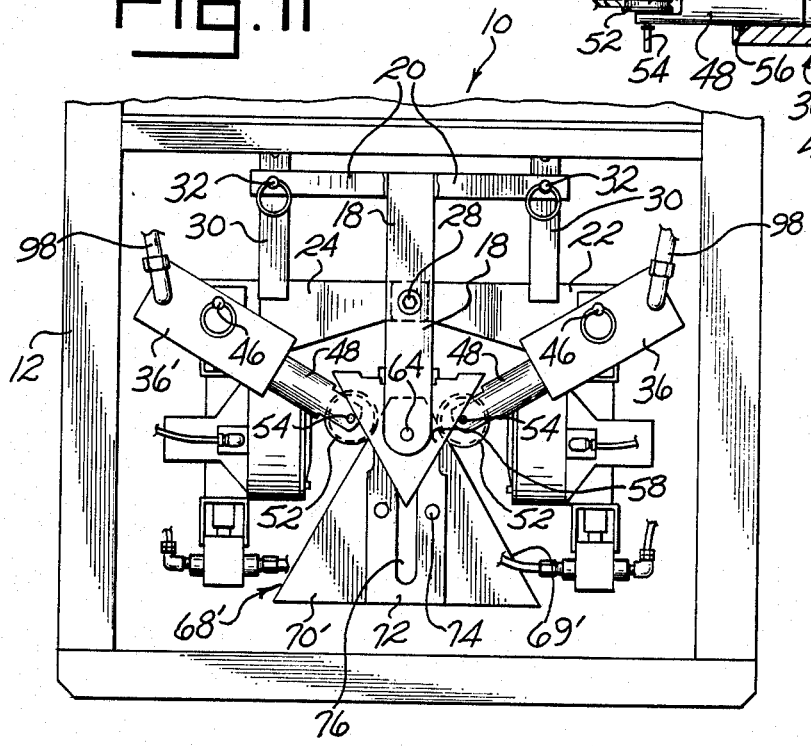
FIG. 11 is a fragmentary front elevational view of the dispenser showing an alternate expelling cam.
Figure 6:
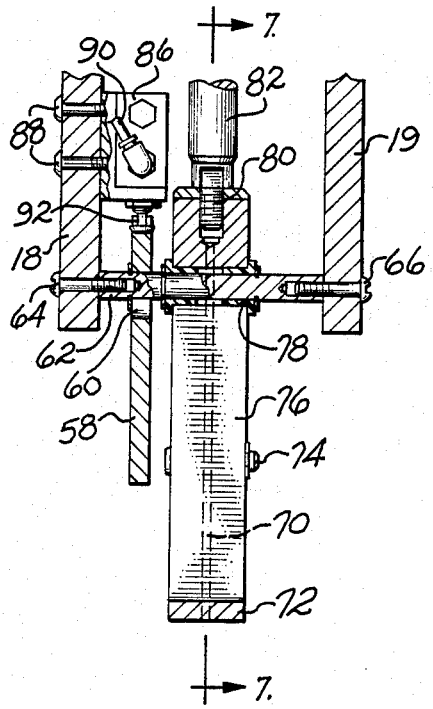
FIG. 6 is a detail view of the area within broken line enclosure 6 of FIG. 3.
Figure 7:
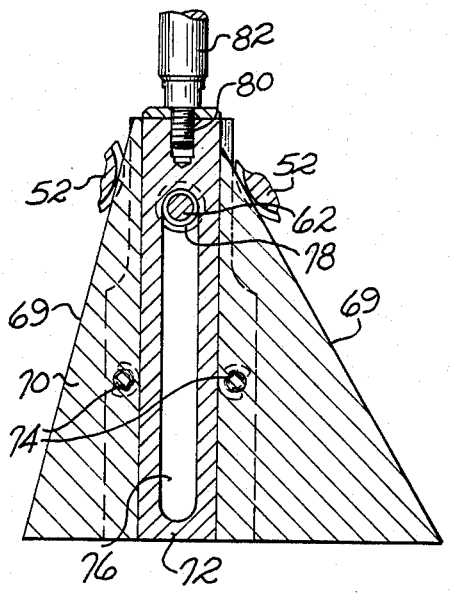
FIG. 7 is a sectional view taken along line 7—7 of FIG. 6.

The preferred embodiments herein described are not intended to be exhaustive or to limit the invention to the precise forms disclosed. They are chosen and described to explain the principles of the invention and its application and practical use to enable others skilled in the art to utilize the invention.

The dispenser 10 shown in the drawings includes a frame 12 which supports a centrally positioned pneumatic cylinder 14. A generally T-shaped yoke 16 which includes parallel body portions 18, 19 and arms 20 is connected to cylinder 14. A pair of spurs 22 and 24 are pivotally connected to yoke body portions 18, 19 by pivot pins 28 and 29. A strut 30 depends from each yoke arm 20 and is connected to the arm by a faspin 32 and to spurs 22 by pivot pins 34.

Connected to each spur 22 is a piston 36, 36'. Each piston 36, 36' includes a cylinder block 40 which has an internal chamber 42 and a bore 43 extending through the block to the chamber. Block 40 is fastened to spur 22 by a fastener such as faspin 46. A rod 48 is restrictively but slidably fitted within chamber 42 and includes a slot 50 at its exposed end. A roller 52 having a peripheral circumferential groove 51 is rotatably secured within rod slot 50 by axle 54 which protrudes transversely outwardly from the rod. An O-ring 56 serves to seal chamber 42 of block 40.

An actuator member, shown as cam 58 in FIGS. 1–11 is positied between pumping pistons 36, 36' adjacent axles 54. Cam 58 is preferably of an isosceles triangular shape and includes a bored vertical central slot 60. A dowel 62 extends through cam slot 60 and is secured to yoke body portions 18, 19 by screws 64, 66. Slot 60 is shaped so as to allow up and down movement of cam 58 relative to yoke 16.

Figure 12:
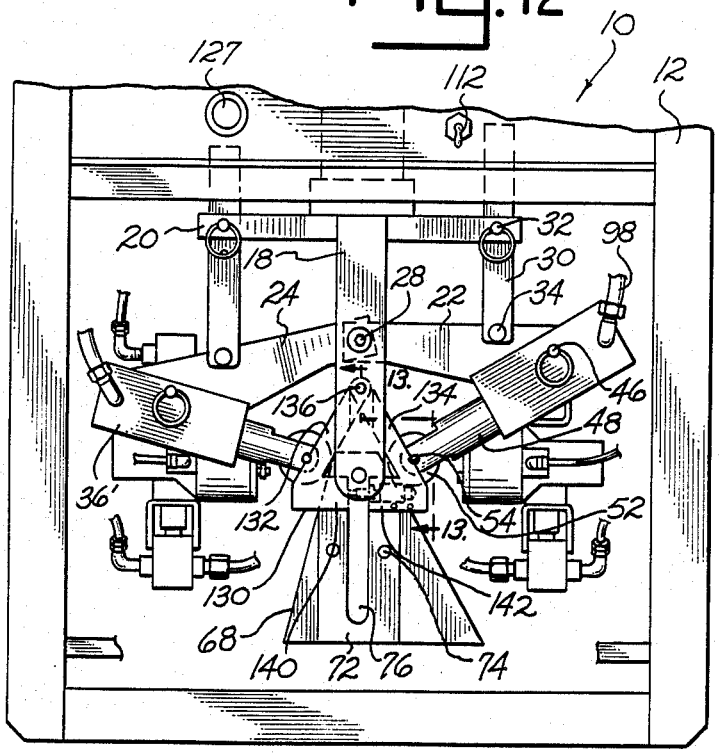
FIG. 12 is a fragmentary front elevational view similar to FIG. 2, showing an alternate form of actuator member.
Figure 13:
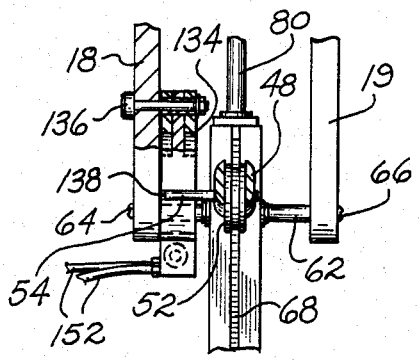
FIG. 13 is a sectional view taken along line 13—13 of FIG. 12.
Figure 14:
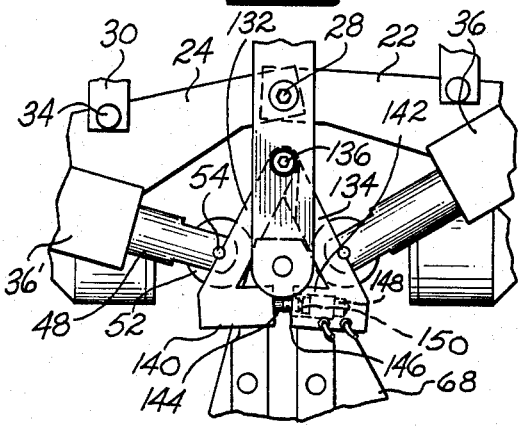
FIG. 14 is a detailed front elevational view of the dispenser of FIG. 12 showing the actuator member activating the expelling cam.

The actuator member may alternatively be formed as a collapsible yoke 130 as shown in FIGS. 12–14. Yoke 130 preferably includes divergent legs 132, 134 pivotally connected by a central pivot pin 136 to yoke body portion 18. Each leg 132, 134 may have a peripheral rabbet 138 which receives a piston rod axle 54 when in the extended position as seen in FIG. 14. Each yoke leg 132, 134 includes a lower foot part 140, 142, respectively, which extend towrads the other foot part in an opposed relationship. A trip member, preferably a screw having threaded shank 144 and an enlarged head 146 is connected to foot part 140 and serves to space foot parts 140, 142 as shown in FIG. 12. Foot part 142 has a bore 148 aligned with screw head 146, with the bore 148 housing a conventional pressure activated switch 150, shown in broken line form in FIG. 12. Lines 152 connect switch 150 to cylinder 14. Threaded shank 144 allows periodic adjustments to be made in the spacing of foot parts 140, 142.

A metering cam 68 is positioned between piston rod rollers 52 behind cam 58 or yoke 130. Metering cam 68 is of triangular shape and includes a pair of right angular cam parts 70 each fitted within a slotted side of a retainer member 72 and held therein by a locked pin 74. Retainer member 72 includes an elongated longitudinal slot 76. Dowel 62 carried by yoke 16 extends through a bushing 78 is slidably fitted in slot 76. A screw 80 connects metering cam 68 to a piston 82 of cylinder 14 which extends freely through a bore 84 in yoke arm 20. Movement of piston rod 82 causes metering cam 68 to move up and down relative to dowel 62 and bushing 78.

A valve 86 is secured to yoke body portion 18 by fasteners 88. Air lines 90 extend from valve 86 and between a compressed air source and pneumatic cylinder 14. A push-button switch 92 is carried by valve 86 and actuates the valve when depressed to allow air delivery to cylinder 14 and valve actuators 104.

Figure 8:
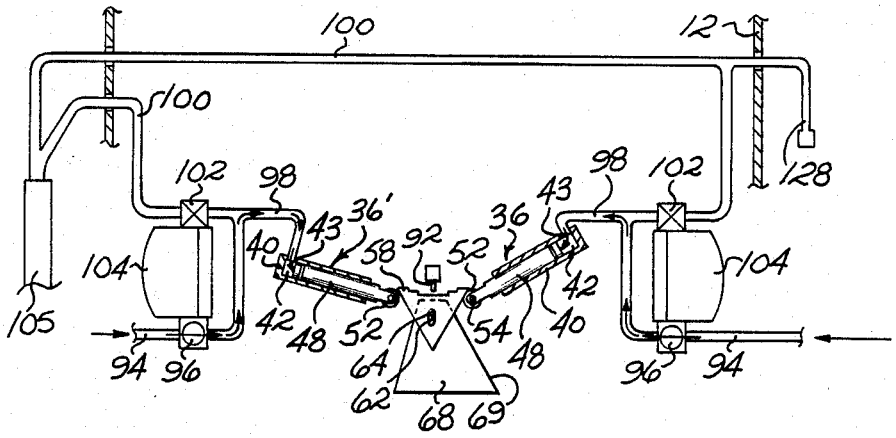
FIG. 8 is a fragmentary schematic view of the dispenser showing fluid entering the piston cylinders.
Figure 9:
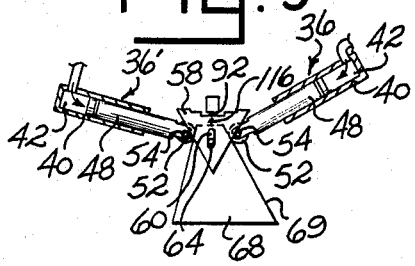
FIG. 9 is an isolated detail view showing the piston rods contacting the actuator which, in the embodiment, is a small cam member.
Figure 10:
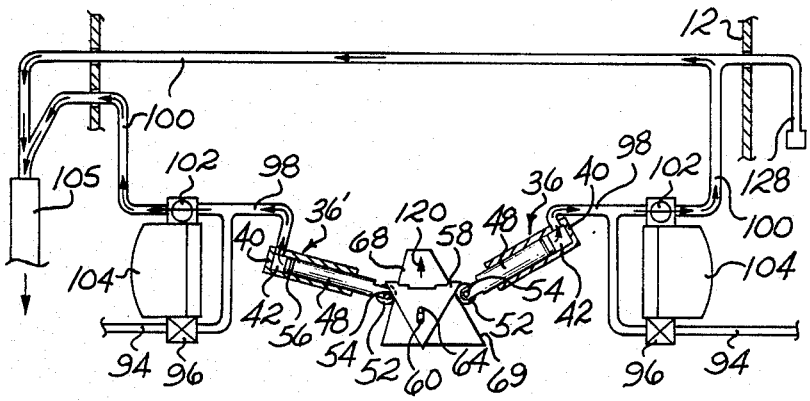
FIG. 10 is a view similar to FIG. 8 showing the expelling cam contacting the piston rods to eject fluid to the mixing head.

FIGS. 8–10 depict the fluid flow through dispenser 10. Each piston 36, 36' is fed by a fluid inlet tube 94, which is controlled by a valve 96. Intake tube 94 is connected to a common fluid tube 98 which communicates with cylinder chamber 42. A fluid outlet tube 100 is in flow communication with common fluid pipe 98 and is controlled by a valve 102. An actuator 104 controls the alternate opening and closing of each valve 96 and 102. Outlet pipes 100 are connected to a mixing head 105 which is connected to a discharge line and nozzle (not shown).

Dispenser 10 is operated as follows. Fluid delivery tanks 106, such as one for an epoxy base and one for the catalyst are connected via couplers 108 to intake lines 110. Lines 110 are in turn connected to inlet tubes 94. A compressed air cylinder or other air source (not shown) is connected to tanks 106 and to an inlet coupling 129 which communicates with an inlet line 90 and pneumatic cylinder 14. On-off switch 112 is switched to 'on' to activate actuators 104 which open valves 96.

FIG. 8 depicts the intake phase of one cycle of dispenser 10. Fluid under pressure from the compressed air source passes from tanks 106 through valves 96 and tubes 94, 98 into cylinder chambers 42 to urge piston rods 48 into their extended position. As the piston rods 48 are extended, roller axles 54 at their protruding ends contact opposite side edges of cam 58 to urge the cam upwardly in the direction of arrow 116 in FIG. 9 until the top edge of the cam 58 contacts push-button switch 92. The piston cylinder chamber 42 will fill with fluid behind piston rods 48 until piston rollers 52 contact the side edge 69 of metering cam 68 at roller grooves 51. Switch 92 will not actuate valve 86 until both piston rollers 52 contact metering cam 68 and cam 58 has been urged upwardly by the joint engagement with piston roller axles 54. In this manner if one or both piston rods are not sufficiently extended by the fluid, the switch will not be depressed sufficiently to actuate valve 86.

Alternatively, if yoke 130 is utilized as the actuator member (FIGS. 12–14), axles 54 will contact yoke legs 132, 134 preferably seated within rabbets 138. As piston rods 48 extend they urge legs 132, 134 and foot parts 140, 142 towards each other as shown in FIG. 14. When the pressure supplied by rods 48 on legs 132, 134 exceeds the preset value of switch 150, this switch triggers metering cam 68 to retract the rods as above described. Due to the central pivot pin 136 which secures legs 132, 134 to yoke portion 18, both sets of rods 48 must contact both legs 132, 134 to urge them together. If, due to malfunction, only one rod 48 contacts its adjacent yoke leg 132 or 134, yoke 130 will merely pivot or swing about pin 136 and switch 150 cannot be activated unless opposing pressure is supplied by the opposite piston rod.

Actuation of switch 92 or switch 150 activates valve 86 and actuators 104 close valves 96 and open valves 102. Simultaneously, air is delivered through air lines 90 to pneumatic cylinder 14 which causes its rod 82 to rise.

FIG. 10 depicts the discharge phase of the cycle. As cylinder rod 82 rises, metering cam 68 is pulled forcefully upwardly (see arrow 120) against piston rod rollers 52 to force rods 48 back into retracted position within their respective chambers 42. This forces the fluids within chambers 42 into common tubes 98, through open valves 102 and into outlet tubes 100 where the fluids pass to mixing head 105 for mixing prior to discharge from the dispenser (not shown).

The ratio of the two ejected fluids from dispenser 10 depends upon the amount of fluid forced from pistons 36, 36' or the effective strokes of piston rods 48. Such strokes of piston rod 48 depend upon the slope of side edges 69 of metering cam 68. In the embodiment shown in FIGS. 1–10, and 12–14 approximately 2 parts fluid enters piston 36 for every 1 part fluid which enters piston 36' during each operative cycle of dispenser 10 to produce a 2 to 1 fluid mixture. In the embodiment shown in FIG. 11, a 1:1 fluid mixture ratio is provided by using a metering cam 68 having equal sloped side edges 69'. For this ratio one cam part 70 is replaced by another cam part 70. To minimize the bending forces upon piston rods 48 and maintain the fluid ratio accuracy of the dispenser, the axis of the rods are located in a perpendicular relationship to the side edges 69 or 69' of cam 68. As the fluid ratio is changed by substitution of cam parts 69, pins 32 are removed and the spurs 22 pivotally adjusted relative to yoke 16 to perpendicularly locate piston rods 48. The pins 32 are replaced in appropriate aligned holes 33 in arm 20 and struts 30.

Dispenser 10 may also include (FIG. 1) a counter 122 to determine the supply of fluid remaining in tanks 106, an air pressure gauge 124 connected to the air cylinder (not shown), and an air filter 126 positioned between the compressed air source (not shown) and pneumatic cylinder 14. A pressure control knob 127 controls the inlet air pressure from the air source.

Dispenser 10 may also include a line 128 (FIG. 10) which communicates with outlet tubes 100. Cleaning solvent may be introduced into line 128 to purge the pipes after each use of dispenser 10.

It is to be understood that the invention is not limited to the details above-given, but may be modified within the scope of the appended claims.

We claim:

1. A machine for dispensing two flowable materials under pressure comprising a frame, first and second generally opposed pistons carried by said frame, each piston including a cylinder defining a chamber, and a rod shiftable relative to said cylinder into and out of said chamber, inlet means for introducing one of said two flowable materials into each piston cylinder chamber at one end of its piston therein, outlet means for dispensing said one flowable material from each piston cylinder, a cam member positioned between said pistons, each piston rod extending outwardly of its said cylinder and contacting at its opposite end said cam member when the chamber cylinder is filled through said inlet means with one of said flowable materials, and power driven means responsive to the outward extension of said piston rods for shifting said cam member relative to each piston rod to simuultaneously urge said rods into said piston cylinder chambers causing said two flowable materials to be discharged through their said outlet means for mixing and discharge from said machine.

2. The machine of claim 1 and a second cam member positioed between said pistons, said power means for effecting said shifting movement of said first-mentioned cam member responsive to movement of said second cam member, said second cam member having said movement to effect said shifting movement of said first-mentioned cam member and contacted by both said piston rods when their cylinder chambers are filled with said flowable materials.

3. The machine of claim 2 wherein said power means for effecting said shifting movement of said first-mentioned cam member includes a component which carries said first-mentioned and second cam members, said second cam member being shiftable relative to said first-mentioned cam member.

4. The machine of claim 3 wherein said second cam member is triangular in shape with two side edges and has a slot therethrough, a pin extending through said second cam member slot and secured to said power means component, said pin in slot constituting guide means for controlling movement of said second cam member relative to said first-mentioned cam member, said piston rods contacting said cam member side edges to so shift said second cam member relative to said first-mentioned cam member.

5. The machine of claim 4 and valve means associated with said inlet means and outlet means, said valve means for regulating material flow through said inlet means and outlet means, switch means for alternatively activating and deactivating said valve means, said switch means responsive to said movement of said second cam member and carried by said power means component.

6. The machine of claim 5 wherein said inlet and outlet means includes a common tube into each piston cylinder chamber, said common tube connected to an inlet tube forming a part of said inlet means and an outlet tube forming a part of said outlet means by said valve means.

7. The machine of claim 2 wherein said frame includes means for adjusting the angular positio of said piston rods relative to said first-mentioned and second cam members.

8. The machine of claim 7 wherein said first-mentioned cam member is triangular in shape with two side edges, each piston rod positioned perpendicular to a said side edge of the first-mentioned cam member.

9. The machine of claim 8 wherein said first-mentioned cam member includes replaceable parts each defining a said side edge of specific slope, said slope constituting means for varying the ratio of discharge of said flowable materials.

10. The machine of claim 2 wherein said power means for effecting said shifting movement of said first-mentioned cam member is pneumatic cylinder.

11. The machine of claim 1 and an actuator member positioned between said pistons for effecting shifting movement of said power driven means, said power driven means for effecting said shifting movement of said cam member responsive to movement of said actuator member.

12. The machine of claim 1 wherein said actuator member movement effects said shifting movement of said cam member whereby both said piston rods contact said cam member when the piston cylinder chambers are filled with said flowable materials.

13. The machine of claim 11 wherein said actuator member includes a yoke pivotally connected to said frame, said yoke including depending divergent legs each positioed adjacent a said piston wherein extending movement of ech piston urges said divergent legs towards each other.

14. The machine of claim 13 wherein one of said divergent legs includes a switch, said switch when closed constituting means for actuating movement of said cam member in response to pressure exerted against the divergent legs by said pistons.

15. The machine of claim 14 wherein another of said divergent legs includes trip means for closing said switch means.

16. A machine for dispensing two flowable materials under pressure, said machine comprising a frame, first and second generally opposed pistons carried by said frame, each piston including a cylinder defining a chamber, and a rod shiftable relative to said cylinder into and out of said chamber, inlet means for introducing said two flowable materials into each piston cylinder chamber at one end of its piston therein, outlet means for dispensing said one flowable material from each piston cylinder, a cam member positioed between said piston rods, each piston rod extending outwardly of its said cylinder and contacting at its opposite end said cam member when the chamber cylinder is filled through said inlet means with one of said flowable materials, and power driven means responsive to the outward extension of sid piston rods for shifting said cam member relative to each piston rod to simultaneously urge said rods into said piston cylinder chambers causing said two flowable materials to be discharged through their said outlet means for mixing and discharge from said machine.

17. The machine of claim 16 wherein said cam member includes side edges, said piston rods contacting said cam member at its said side edges, said cam member side edges defining slopes of varying degrees, said slopes constituting means for varying the ratio of discharge of said two flowable materials.

18. The machine of claim 16 wherein said frame includes means for adjusting the angular position of said piston rods relative to said cam member side edges.

19. The machine of claim 18 wherein said cam member is triangular in shape, each piston rod positioned perpendicular to a said cam member side edge.

* * * * *